US010458079B2

(12) United States Patent
Bright

(10) Patent No.: US 10,458,079 B2
(45) Date of Patent: Oct. 29, 2019

(54) BRIDGING SYSTEM

(71) Applicant: Bright Structures Limited, Exeter (GB)

(72) Inventor: Stephen Bright, Exeter (GB)

(73) Assignee: Bright Structures Limited, Exeter (GB)

( * ) Notice: Subject to any disclaimer, the term of this patent is extended or adjusted under 35 U.S.C. 154(b) by 0 days.

(21) Appl. No.: 16/066,776

(22) PCT Filed: Dec. 22, 2016

(86) PCT No.: PCT/IB2016/057935
§ 371 (c)(1),
(2) Date: Jun. 28, 2018

(87) PCT Pub. No.: WO2017/118890
PCT Pub. Date: Jul. 13, 2017

(65) Prior Publication Data

US 2019/0024331 A1 Jan. 24, 2019

(30) Foreign Application Priority Data

Jan. 8, 2016 (GB) ..... 1600310.5

(51) Int. Cl.
*E01D 21/06* (2006.01)
*E01D 21/08* (2006.01)
*E01D 15/133* (2006.01)

(52) U.S. Cl.
CPC ..... *E01D 15/133* (2013.01); *E01D 21/06* (2013.01); *E01D 21/065* (2013.01); *E01D 21/08* (2013.01)

(58) Field of Classification Search
CPC ..... E01D 19/02; E01D 19/125; E01D 21/06; E01D 21/065; E01D 21/08; E01D 21/00; E01D 6/00; E01D 2101/30; E01D 15/133
See application file for complete search history.

(56) References Cited

U.S. PATENT DOCUMENTS 976,074 A 11/1910 Hartman
3,027,633 A * 4/1962 Murphy ..... E01D 21/06 14/4

(Continued)

FOREIGN PATENT DOCUMENTS

FR 465200 A * 4/1914 ..... E01D 15/133
GB 2434822 A 8/2007
GB 2471850 A 1/2011

OTHER PUBLICATIONS

Patents Act 1977: Combined Search and Examination Report under Sections 17 and 18(3), UK Intellectual Property Office, Application No. GB1600310.5, dated Jul. 22, 2016.

*Primary Examiner* — Abigail A Risic
(74) *Attorney, Agent, or Firm* — Reichel Stohry Dean LLP; Mark C. Reichel

(57) ABSTRACT

A bridging system comprising a bridge (10) and a trolley (70), the bridge comprising a bridge deck (40) having at least two pre-formed bridge sections (42), the trolley including a set of wheels (573) with a track width configured such that in use with the trolley located on the bridge deck, at least one wheel contacts one stringer (443A) and at least one other wheel contacts another stringer (443B), the system further including tracking means for maintaining the at least one wheel in contact with the one stringer and for maintaining the at least one other wheel in contact with the other stringer such that the trolley and bridge deck may remain in contact while moving relative to, or with, one another for the launching of the bridge deck over a space to be bridged, the trolley being configured to carry goods and/or personnel over, and along, the bridge deck after the bridge has been positioned over the space to be bridged.

12 Claims, 4 Drawing Sheets

(56) References Cited

U.S. PATENT DOCUMENTS

| | | | | | |
|---|---|---|---|---|---|
| 5,960,502 | A * | 10/1999 | Sherman | E01D 21/06 | 14/77.1 |
| 5,987,680 | A * | 11/1999 | Sakaya | E01D 19/125 | 14/73 |
| 6,574,818 | B1 * | 6/2003 | Matiere | E01D 2/04 | 14/73 |
| 7,461,427 | B2 * | 12/2008 | Ronald | E01D 19/125 | 14/77.1 |
| 8,474,080 | B2 * | 7/2013 | Kim | E01D 2/02 | 14/77.1 |
| 8,671,490 | B1 * | 3/2014 | Carney | B66C 19/005 | 14/77.1 |
| 8,925,132 | B1 * | 1/2015 | Quinonez | E01D 2/02 | 14/73 |
| 9,739,019 | B1 * | 8/2017 | Godbersen | E01C 19/004 | |
| 2006/0143840 | A1 * | 7/2006 | Steppacher | E01D 15/133 | 14/2.4 |
| 2006/0162102 | A1 * | 7/2006 | Nelson | E01D 2/00 | 14/77.1 |
| 2013/0061406 | A1 * | 3/2013 | Southworth | E01D 19/125 | 14/73 |
| 2018/0291570 | A1 * | 10/2018 | Lee | E01D 21/06 | |

* cited by examiner

BRIDGING SYSTEM

PRIORITY

The present application is related to, and claims the priority benefit of, and is a 35 U.S.C. 371 national stage application of, International Patent Application Serial No. PCT/IB2016/057935, filed Dec. 22, 2016, which is related to, and claims the priority benefit of, Great Britain Patent Application Serial No. 1600310.5, filed Jan. 8, 2016. The contents of each of these applications are hereby incorporated by reference in their entirety into this disclosure.

TECHNICAL FIELD

The present invention relates generally to a bridging system and a method of bridging a space and finds particular, although not exclusive, utility in temporary bridges which may be carried in disassembled form for assembly and subsequent use without the need for lifting gear.

BACKGROUND

In military situations if soldiers need to get across a space such as a ravine or gully, without going down and back up the other side, it is known to use ropes to set-up a so-called Tyrolean traverse. However, they are slow to cross and the first person has to cross potentially without the rope being anchored correctly on the other side.

Bridges are well known but are either typically too heavy to carry requiring vehicles and the like, or require extensive equipment to construct and lifting gear such as cranes to install.

It is desirable to have a bridging system which may be carried by one or more people, and which is relatively easily assembled and installed.

BRIEF SUMMARY

The present invention provides in a first aspect, a bridging system comprising a bridge and a trolley, the bridge comprising a bridge deck having at least two preformed bridge sections, each having at least two stringers, each at least two stringers connected together by a floor beam, and a connection means for releasably connecting the at least two bridge sections together, the trolley including a set of wheels with a track width configured such that in use with the trolley located on the bridge deck, at least one wheel contacts one stringer and at least one other wheel contacts another stringer, the system further including tracking means for maintaining the at least one wheel in contact with the one stringer and for maintaining the at least one other wheel in contact with the other stringer such that the trolley and bridge deck remain in contact while moving relative to, or with, one another for the launching of the bridge deck over a space to be bridged, the trolley being configured to carry goods and/or personnel over, and along, the bridge deck after the bridge has been positioned over the space to be bridged.

In use, the bridge sections may be carried separately and connected together as required. The trolley may be used for launching the bridge over the space in a substantially horizontal manner. Inclined launches are also possible with sufficient manpower. The same or a different trolley may then be used to cross the bridge carrying men and materials. In its simplest form the bridge sections may be ladders, the connection means permitting them to be connected together.

The ladders may comprise aluminium or similar lightweight materials including advanced composite materials. The bridge sections may have a uniform width to then allow the trolley to run across the top thereof.

The term 'pre-formed' in relation to the bridge sections may mean pre-assembled. Alternatively, each bridge section may have been fabricated as a unitary piece.

The bridge deck may have a width in the range of 20 cm to 100 cm. The bridge system may be arranged to allow a weight of at least 50 kg to pass over it when installed.

The bridge deck may have a deck plane lying parallel thereto in which the at least two stringers both lie, and the system may further comprise at least one deck column extendable out of the deck plane away from the bridge deck, and at least one cable for connecting the bridge deck to the at least one deck column. The at least one deck column may be extendable away from the bridge deck at an angle lying between 40 and 140 degrees from the deck plane.

This column may allow for a triangular truss shape to be created with it and the cable attaching to the bridge deck. The bridge may be assembled with the deck plane substantially horizontal and the column projecting upwardly from it. Alternatively, the bridge may be assembled with the deck plane being vertical and the column extending outwardly horizontally to one side. After assembly the bridge may be slid out over the trolley and across the space. The bridge may then be rotated either through 180 degrees if the column was above the deck or through 90 degrees if the column was to the side such that the column is now below the deck. In this way the column will not impede the movement of the trolley across the upper surface of the deck. In other words, the at least one column may be arranged on the opposite side of the bridge deck from the side/surface of the bridge to be used by the trolley.

The at least one column may be releasably attachable to the bridge deck. For instance, nuts and bolts, split pins or a simple push-fit connection may be used to attach it. The column may be initially separate so as to increase the ease with which the various parts of the bridge may be shared amongst the users.

The at least one column may be releasably attachable to an end of at least one bridge section. Other locations are contemplated such as at a point mid span of the bridge section.

The at least one column may be pivotably attached to at least one bridge section. For instance, it may be pivotably attached to an end of at least one bridge section. In this way, the bridge could be assembled more quickly. Means to lock the column in a certain position with respect to the deck plane may be provided such as split pins, simple push-fit connections and the like.

The connection means for connecting the at least two bridge sections together may comprise a hinge such that in a first position the at least two stringers of each bridge section lie immediately adjacent one another, and in a second position the at least stringers of each bridge sections are linearly located in line with one another. For instance, a folding ladder may be used to reduce assembly time. Means to lock the bridge sections in certain positions with respect to each other so as to create a flat bridge deck may be provided such as split pins and the like.

The at least two stringers may be linearly hollow and the connection means for connecting the at least two bridge sections together may comprise a member configured for insertion into an end of two linearly adjacent stringers. For instance, aluminium box-section ladders are typically hollow. The connecting member may be a rod or a hollow member having a cross-section which snugly fits into the end of each ladder box-section and extends within each end of each adjacent stringer by approximately 10 to 400 mm. The connecting member may include a quick-release thumb-press fastener to allow it to be removed from ladder ends, to minimise ladder lengths in transit. Longer lengths help to prevent the pulling-apart of adjacent stringers by the inclusion of restraints such as pins, or the like, passing therethrough. Shorter connecting members may rely on external restraints such as clamps, strapping or the like.

The bridging system may further comprise a launch nose section releasably attachable to one end of the bridge deck to aid launching of the bridge over the space to be bridged. This may take the form of another bridge section or a rod or other stiff linear member which allows the other side to be reached while more of the bridge length remains on the launching side. The launch nose ensures touch-down on the opposite side is achieved while a substantial portion of the overall length of the bridge remains on the near side. This helps prevent the bridge toppling over during launch and helps the structure cope with peak launch loading effects. The overall length of the bridge, including the launch nose section may be arranged such that the portion between the nearest two masts remains on the near side at all times until the nose has reached the opposite side. It may be preferable for this portion to also remain distal, relative to the void to be bridged, of any trolley being used to assist in the launch.

The launch nose may assist with the subsequent rotation of the bridge after it has been pushed all the way across such that the bridge deck rests on both sides of the space. The launching nose may be telescopic, or comprise sectional tapering tubes.

The bridging system may further comprise a tail section releasably attachable to one end of the bridge deck for loading thereof to reduce the mass of counterweight required to balance the structure during the launch of the bridge over the space to be bridged. This may take the form of another bridge section or a beam or other stiff linear member which allows the near end of the bridge to be weighted down to prevent the bridge tipping over and into the space before the other side is reached during launching. The tail section may be telescopic, or comprise sectional tapering tubes.

The bridge deck may have a deck plane lying parallel thereto in which the at least two stringers both lie, and the system may further comprise at least one side column extendable away from the bridge deck substantially parallel to the deck plane, and at least one cable for being arranged to one side of the bridge deck by the at least one side column. This side column may allow for a triangular truss shape to be created with it and the cable to the side of the bridge deck. Alternatively, the side column may extend from the bridge deck in a direction non-parallel to the deck plane, for instance at an angle in the range of 5 to 50 degrees below the horizontal.

The bridging system may further comprise an outrigger arrangeable at either, or both, ends of the deck section. The outrigger may comprise a rigid linear member arranged with its longitudinal length parallel to the deck plane and perpendicular to the longitudinal length of the bridge deck. It may act to improve the stability of the bridge in use to prevent swaying or overturning thereof.

In a second aspect, the invention provides a bridging system comprising a bridge and a trolley, the bridge comprising a bridge deck having at least two pre-formed bridge sections, each having at least two stringers, each at least two stringers connected together by a floor beam, each at least two bridge sections connected together by connection means, the trolley including a set of wheels with a track width configured such that in use with the trolley located on the bridge deck, at least one wheel contacts one stringer and at least one other wheel contacts another stringer, the system further including tracking means for maintaining the at least one wheel in contact with the one stringer and for maintaining the at least one other wheel in contact with the other stringer such that the trolley and bridge deck remain in contact while moving relative to, or with, one another for the launching of the bridge deck over a space to be bridged, the trolley being configured to carry goods and/or personnel over, and along, the bridge deck after the bridge has been positioned over the space to be bridged.

In this aspect, the bridge has been assembled or is provided ready assembled. This may occur in situations where the space to be crossed is relatively narrow such that an assembled bridge may be carried by the users. The following features have the same characteristics and advantages as described above.

The bridge deck may have a deck plane lying parallel thereto in which the at least two stringers both lie, and the system may further comprise at least one first deck column extending out of the deck plane away from the bridge deck, and at least one first cable connecting the bridge deck to the at least one first deck column, the at least one first cable attached towards both ends thereof to the bridge deck either side of the at least one first deck column.

The at least two stringers may be linearly hollow and the connection means connecting the at least two bridge sections together may comprise a member inserted into an end of two linearly adjacent stringers. Alternatively, or additionally, an external sleeve, or external clamp may be used as the connection means.

The bridging system may further comprise a launch nose section releasably attached to one end of the bridge deck to aid launching of the bridge over the space to be bridged. The bridging system may further comprise a tail section releasably attached to one end of the bridge deck for loading thereof to aid launching of the bridge over the space to be bridged. The bridge deck may have a deck plane lying parallel thereto in which the at least two stringers both lie, and the system may further comprise at least one side column extending away from the bridge deck substantially parallel to the deck plane, and at least one cable arranged to one side of the bridge deck extending around the at least one side column and attached at both ends thereof to the bridge deck either side of the side column. Alternatively, the side column may extend from the bridge deck in a direction non-parallel to the deck plane, for instance at an angle in the range of 5 to 50 degrees below the horizontal. The bridging system may further comprise an outrigger releasably attached at or near either, or both, ends of the deck section.

The at least one bridge section may comprise at least two bridge sub-sections connected together by connection means, and at least one second deck column may be arranged at or near each junction of the bridge sub-sections extending out of the deck plane away from the bridge deck, the at least one second deck columns being substantially shorter than the at least one first deck columns, the system may further comprise at least one second cable or rod suspended over the bridge deck by the at least one second deck column, the at least one second cable or rod attached towards both ends thereof to the bridge deck either side of the at least one second deck column.

The at least one second cable or rod may be attached to the bridge deck at or near each end of the bridge sub-section.

Any of the at least one first or second deck columns may be extendable away from the bridge deck at an angle lying between 40 and 140 degrees from the deck plane.

In a third aspect, the invention provides a method of bridging a space comprising the steps of: providing a bridging system according to the first aspect; assembling the bridge on one side of the space to be bridged; arranging the trolley with the wheels uppermost and sliding the assembled bridge out over the space until the bridge spans the space.

In a fourth aspect, the invention provides a method of bridging a space comprising the steps of providing a bridging system according to the first aspect; assembling the bridge on one side of the space to be bridged; arranging the trolley with the wheels lowermost; arranging the bridge on top of the trolley; and rolling the assembled bridge out over the space until the bridge spans the space.

In a fifth aspect, the invention provides a method of bridging a space comprising the steps of providing a bridging system according to the first aspect; part-assembling the bridge on one side of the space to be bridged; arranging the trolley with the wheels uppermost and sliding the part-assembled bridge out over the space, and adding further bridge sections, columns, and tensioning members, and further launching the extended bridge structure until the bridge spans the space.

In any of the third to fifth aspects, the space may be spanned relatively safely and easily from one side.

The step of sliding or rolling the assembled bridge out over the space may be undertaken with the at least one deck column above or parallel to the horizontal, and the method may further comprise the step of rotating the bridge, such that the at least one column is underneath the bridge deck, after the bridge has been arranged to span the space.

The method may further comprise the step of providing a trolley to run on the upper surface of the bridge deck to thereby transfer goods and/or personnel from one side to the other side of the space.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
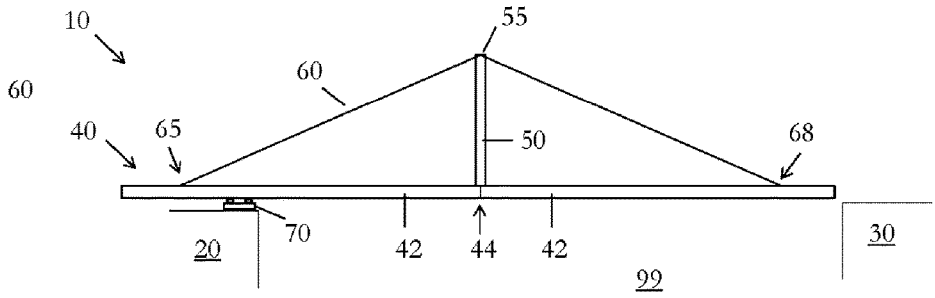
FIG. 1 is an elevational schematic view of a first bridging system being launched.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1 a bridging system 10 is shown partially extending across a void defined by two opposing abutments 20, 30. The bridging system comprises a bridge deck 40 having two sections 42 connected together at each end thereof. The two sections 42 have similar lengths, although that need not be the case. They are rectangular in plan with two long side and two short sides. The two sections are joined together at their short sides 44.

A deck column 50 is arranged vertically upwards from the mid point 44 of the bridge deck 40. Although shown as extending away from the mid-point of the bridge deck other positions are contemplated. Although shown as extending upwardly perpendicularly to the bridge deck it is to be understood that it could tend away at other angles such as between 40 and 130 degrees, between 50 to 120 degrees, between 60 to 110 degrees, or between 70 to 100 degrees. It is attached to the bridge deck 40. The attachment may be made as part of the connection means used to join to adjacent bridge sections, although other means, such as bolts, or push-fit sockets, directly connecting the deck column to the deck are envisaged too.

A cable 60 is arranged to pass over, or connect to, the top 55 of the deck column. The cable 60 is attached 65, 68 to the bridge deck 40 at each end thereof. The connection may be stepped inwards towards the mid-point 44 rather than being at the very end of each end so as not to foul the abutments 20, 30 when the bridge is inverted.

The cable 60 may be attached to the top of the deck column 50 or may merely rest thereon, possibly with the use of a pulley or cable saddle. The cable 60 may be a rope, chain, wire, webbing, or any other inextensible flexible member. Alternatively, it may be an axially stiff member such as a rod or series of rods.

In use the bridge 10 is assembled on one side 20 of the space to be bridged (void 99). The trolley 70 is placed near, or at, the edge of the abutment 20 and the bridge 10 placed thereon with the deck column 50 above the deck 40. Alternatively, the bridge 10 may be placed such that the deck column 50 projects approximately horizontally.

The bridge 10 may be assembled on the trolley to avoid having to lift it onto the trolley.

The trolley 70 is typically arranged with the wheels uppermost so that it remains stationary relative to the abutment 20.

The bridge 10 is then pushed out over the void 99 using the trolley wheels to move the bridge relatively easily. The bridge may also be built incrementally as it is pushed out over the space to be bridged.

Figure 2:
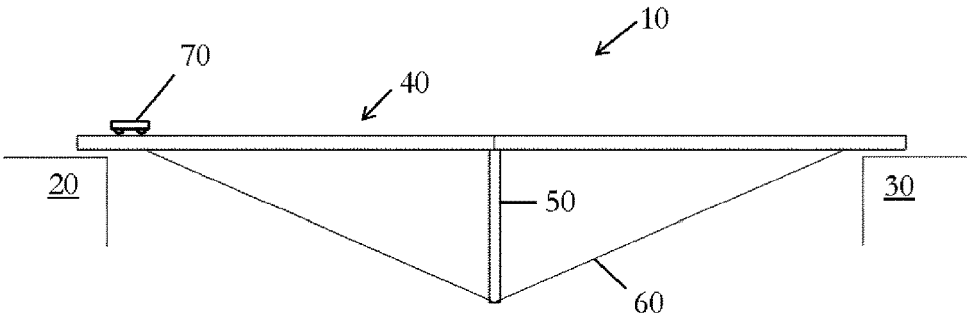
FIG. 2 is an elevational schematic view of the bridge of FIG. 1 after being launched and rotated into position.

Once the far end of the bridge has reached the other side of the void 99 such that the end of the bridge deck 40 is resting on the abutment 30 the bridge may be rotated about an axis passing through its longitudinal length and lying approximately horizontally. The bridge 10 will then appear similar to the one shown in FIG. 2.

It is contemplated that the rotation of the bridge about its longitudinal axis may occur in two stages. A first rotation of 90 degrees when the far end of the bridge (or launch nose section, if provided) has just reached the far side, followed by another 90 degrees rotation when the bridge has progressed further such that, if provided, all of the nose section is on the far side. Alternatively, the bridge may be fully rotated through 180 degrees after the nose section is on the far side The trolley 70 can then be removed from underneath the near end and placed on the bridge deck 40 such that it can be moved therealong to transfer men and materials to the other side. In certain situations, the trolley may not be required for launching the bridge. Instead, the bridge may be slid directly over the terrain, for instance if the frictional characteristics allow.

Figure 3:
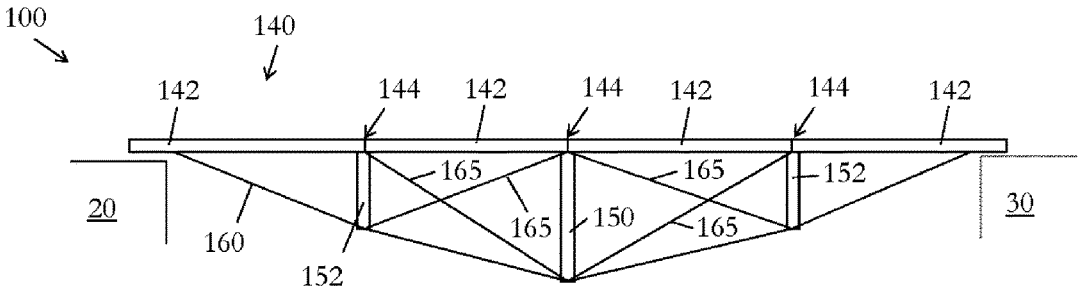
FIGS. 3 to 5 are elevational schematic views of a second to fourth bridging systems.

Another example of a bridge system is shown in FIG. 3. This bridge 100 has a bridge deck 140 which comprises four bridge sections 142. Each section 142 is joined to the next adjacent one such that the four lie rectilinearly in form. The connection points are referenced 144.

A first deck column 150 projects downwardly from the mid-point of the bridge having a first height, and a second deck column 152 projects downwardly from the connection points 144 either side of the mid-point. The two second deck columns 152 have a shorter height than the first deck column 150, however, it will be understood that they may have the same height.

A cable 160 passes over, or is connected to, the ends of the deck columns 150, 152 opposite the ends attached to the bridge deck 140. The cable 160 is attached to the bridge deck 140 at each end thereof, or stepped inwards towards the mid-span, in a similar manner to that described with reference to FIG. 1.

Further cables 165 are provided between the first deck column 150 and each of the second deck columns 152 in a cross shape, such that, for instance and with reference to a second deck column shown on the left of the first deck column 150, a first other cable 165 extends from the base of the second deck column (where it is attached to the bridge deck 140) to the top of the first deck column 150. A second other cable 165 extends from the base of the first deck column 150 near, or at, the point of connection of the first deck column 150 with the bridge deck 140, to the top of the second deck column 152. This forms the cross shape such that there are multiple triangular shapes created for strength and stiffness of the bridge 100.

The same is repeated with other cables 165 arranged between the first deck column 150 and the other second deck column 152, which is located to the right of the first deck column 150 as shown in FIG. 3.

The bridge 100 in FIG. 3 will have been assembled with the first and second deck columns above, or to the side of, the bridge deck 140 and then launched across the void and then rotated such that the columns 150, 152 are beneath the bridge deck 140.

Figure 4:
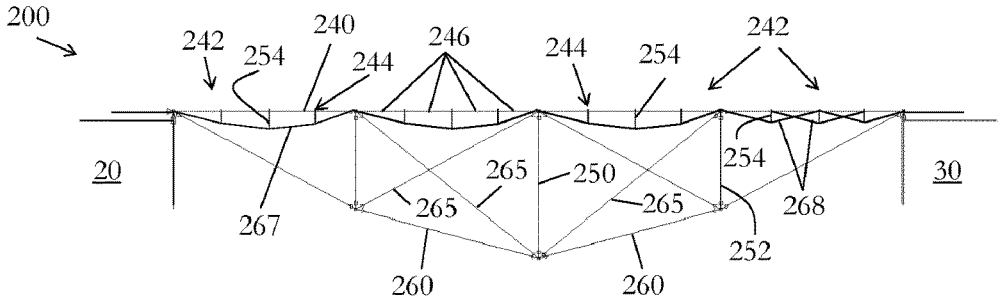

In FIG. 4, another bridge 200 is shown spanning a void. This bridge also has four sections 242 forming a bridge deck 240. However, each section 242 comprises four sub-sections 246. The sub-sections 246 may be equal in length although other arrangements are contemplated. Each sub-section is connected to adjacent sub-sections 246 in a linear manner, as before, to create a rectilinear bridge deck 240.

At the junction 244 of each sub-section 246 within the length of each section 242, but not at the ends of each section 242, a third deck column 254 is provided. The height of each third deck column 254 may be substantially shorter than the first 250 and second deck columns 252. The height of each third deck column 254 may vary dependent on its location within each section 242. For instance, FIG. 4 shows that the third deck column 254 at the centre of each section 242 may be the tallest with the third deck columns 254 arranged at the adjacent junctions either side being slightly shorter. In this way with another cable 267 arranged over the distal ends of the third deck columns and attached to each end of each section 242 a "bow" shape is effected with the cable 267.

However, an alternative arrangement is shown in the right hand section 242 where the third columns 254 all have approximately the same height. In this section cables 268 pass over the top of each third column and are attached the to the bridge deck at the base of each adjacent column 252, 254, or to the end of the bridge deck 240. This creates a criss-cross arrangement of cables and columns 254. This alternative arrangement may be used entirely across the bridge in all sections, or in only one or more sections.

The third columns 254 may be arranged distanced from the junction 244 of each subsection 246 in an alternative arrangement.

The other aspects of the bridge 200 are similar to the aspects of the bridge 100 shown in FIG. 3 with a cable 260 arranged across the tops of the first 250 and second deck columns 252 and attached to the bridge deck 240 at each end thereof, and intermediate crossed cables 265 between the second deck columns 252 and the first deck column 250.

It is possible to use the trolley to launch bridges wherein the trolley is arranged with its wheels lowermost such that it moves on the ground with the bridge supported above so that the bridge and trolley move together. A bridge section may be laid on the ground for the wheels of the trolley to roll over in case the ground is soft leading to the wheels becoming stuck. Alternatively, the wheels may have relatively wide portions to spread the weight of the bridge and avoid getting stuck.

In some circumstances the trolley must be located underneath one of the deck columns and stay in that location while launching of the bridge occurs to maintain structural integrity of the bridge. Furthermore, it may be necessary to use more than one trolley at the same time located at various points of the bridge during launch.

Figure 5:
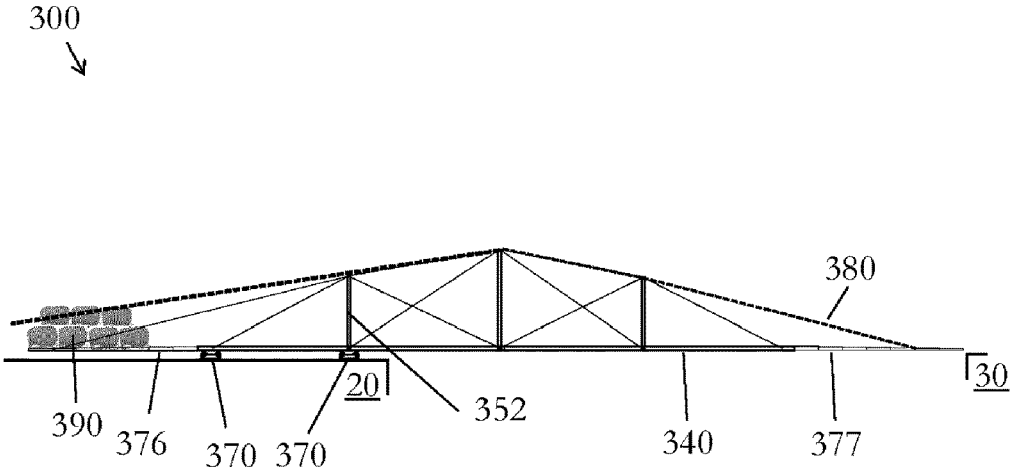

The bridge 300 in FIG. 5 also has four sections; however it also includes a tail section 376 onto which a load 390 has been placed as a counter-balance for launching. The tail section may be removably attached to one outer end of the bridge deck in a continuous rectilinear manner. The bridge 300 also has a nose section 377 at the opposite end to the tail section. This extends from the bridge deck in a continuous rectilinear manner. The nose section may be removably attachable.

The nose section 377 may enable the far side 30 to be reached more easily and with less of the bridge 300 suspended over the void beneath. This increases the length of bridge maintained on the near side thus minimising induced stress in the structure.

The nose and tail sections are shown as telescopic members although other possibilities are contemplated such as rigid members.

The bridge 300 in FIG. 5 is shown resting on two trolleys 370. The trolleys 370 are shown with their wheels uppermost but it is also possible to use them with their wheels lowermost if appropriate.

One trolley 370 is arranged underneath the second deck column 352 nearest the launching side of the void. It may be important to maintain this relationship during launching as much as possible for stability reasons.

A guide rope 380 is also depicted in FIG. 5. This guide rope is attached to the nose section 377 and passes over the top of the first and second deck columns. The other end may be held by personnel at the launching side to help lift and guide the bridge nose towards the far side as it is launched. The guide rope may be used to lift up the nose slightly at least partially to counter-act the natural bending of the launch nose section due to gravity.

Although not shown, other ropes may be attached to the nose and extend to the near side where they may be pulled by personnel to help guide it horizontally. These cables may be retained when the bridge is inverted to act as landside guy-cables to provide lateral stiffening to the structure in-use.

Figure 6:
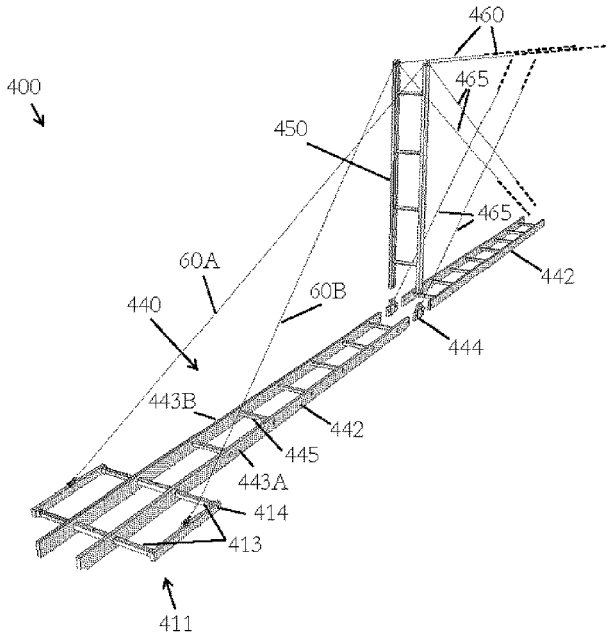
FIG. 6 is a perspective schematic view of a fifth bridging system.

FIG. 6 shows one embodiment 400 of the system in which the bridge deck 440 comprises two ladders 442 attached end to end by two "T" pieces 444 located one on each stile 443A, 443B (or stringer). The two opposite arms of each "T" piece are inserted into the hollow stiles with the third arm projecting upward and away from the deck 440 onto which a deck column 450 may be arranged.

The deck column 450 is shown as another ladder section having the same width as the bridge deck 440. The column 450 may comprise hinged, articulating or interlocking sections for ease of transportation. Tapering "V" shaped columns or single-pole columns, stiffened by knee-braces are also contemplated as alternatives.

An outrigger 411 is provided at one end of the bridge deck 440. It comprises a pair of arms 413 which extend away from the bridge deck in the same plane as, and on either side of, the bridge deck. These arms 413 may be an extension of the rungs 445 which extend between each stile 442. A connecting member 414 extends between the radially outer ends of the two arms 413 on each side of the bridge deck 440.

Cables 60A, 60B are arranged to extend from across the deck 440 from each end thereof, arranged side-by-side extending from each connecting member 413 at one end, crossing over one another and meeting at the top of the deck column 450 and then extending to each stile or connecting member 414 at the opposite end of the deck 440. Cables or ropes may pass around pulleys at their intersection with the deck column 450, or deck stiles. Ropes may be anchored or tensioned via lockable pulleys, or one-way clutches at their intersection with deck columns or stiles. Anchorage points may be adjusted by inclusion of further pulleys, or block and tackle systems.

Figure 7:
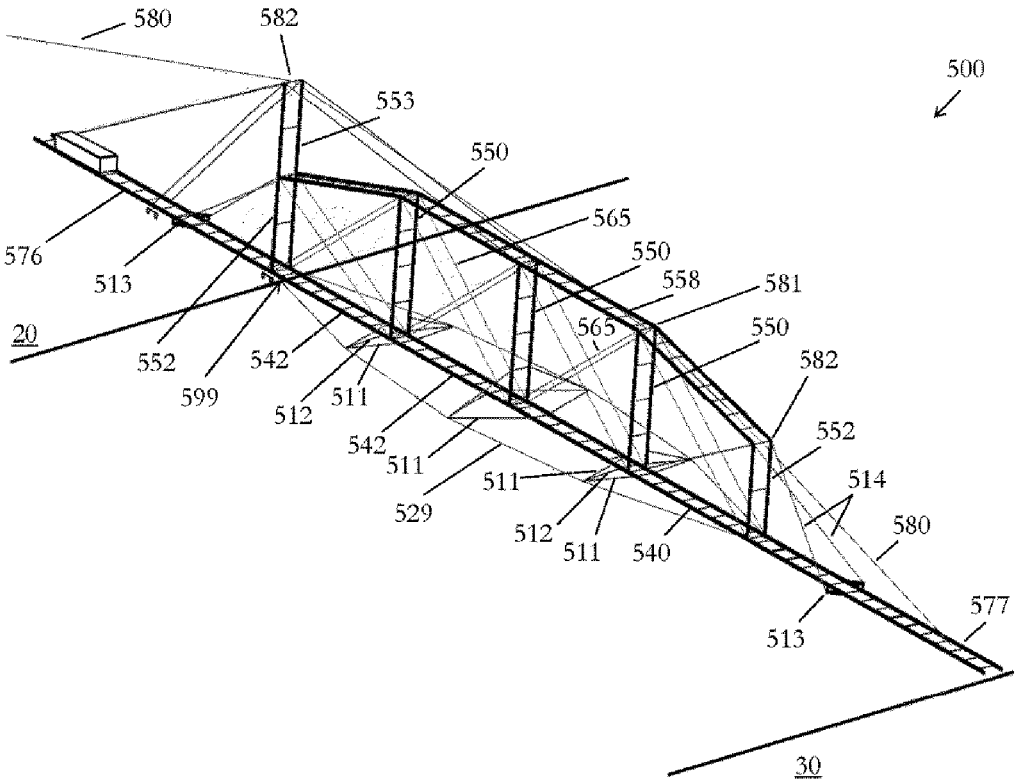
FIG. 7 is a perspective schematic view of a sixth bridging system.

In FIG. 7, an alternative bridge system 500 is shown in the inverted launching state. It comprises six bridge sections 542, a tail section 576 and a nose section 577.

Deck columns 550, 552 are arranged at the junction of the six bridge sections, with the two outermost 552 having a reduced height compared with the middle three 550 which have an equal height.

Cables 565 are arranged connecting to the bridge deck 540 at the base of each deck column to the ends of each deck column creating a crossed effect.

The ends of each deck column 550, 552 are also connected together by further sections of rigid members forming upper deck column bracing 558. These rigid members may be further bridge sections 542 as they have the same width as the bridge deck. They may be ladder sections.

The bridge 500 also includes outriggers 511 in the form of stiff members projecting from the bridge deck 540 in a plane parallel with the bridge deck. Pairs of outriggers 511 are arranged on each side of the bridge deck at the points where the middle three deck columns meet the bridge deck. The ends of each pair are spaced from another at the bridge deck ends but meet at their other ends forming a triangular shape. A cable or strut 512 is arranged from the point at which each pair of outriggers meet and attached to the nearest deck column at a height above the deck bridge 540.

A cable 529 is arranged on one side of the bridge to extend from the bridge deck at a point where the first outer deck column 552 meets the bridge deck, across the end of each pair of outriggers terminating at the point where the other outer deck column 552 meets the bridge deck. Another cable is arranged on the other side of the bridge deck in a similar manner.

These cables may be known as "bowstring cables" and act to oppose lateral deformation of the structure in use and during rotation/inversion following launch. FIG. 7 shows one particular pattern of bowstring cables and struts. Alternative patterns are contemplated depending on span length, first and second column spacing and launch nose section provision.

Pairs of shorter extending outriggers 513 are also arranged at each end of the bridge structure, close to junction of the tail and nose sections with the main bridge deck 540. Cables 514 are attached to the point where each pair meet and extends up to the top of the nearest outer deck column 552 on the opposite transverse side of the bridge deck to form a cross shape for further strengthening of the bridge structure.

The outer deck column 552 nearest the near side abutment 20 includes an extension column 553 which increases its height beyond the height of the central three deck columns 550. It includes cables attached to the end of the tail section crossing over its top and attached to the upper deck column bracing 558. Further cables are also attached to the tail section at one end and the top of the extension column 553 at the other to provide support.

A guide rope 580 is shown extending from the nose section passing over the top of the nearest outer deck column 552, and then extending on to the top of the next adjacent deck column 550 where it passes over (possibly via pulleys) before extending to the top of the extension column 553 at the other outer deck column 552, where it passes over, and then extending to the near side where personnel may hold it and use it to help lift the nose section during launch of the bridge.

The various outriggers 511, 513 and cables 529, 514, 565, together with the deck columns, bridge sections 542 and upper deck bracing 558 all help to increase torsional stability and structural integrity during launch installation and subsequent inversion (rotation).

During launch a trolley (not shown) is arranged underneath 599 the outer deck column 552 which has the extension column 553 and moves with the bridge as it is moved out over the space to be bridged.

Figure 8:
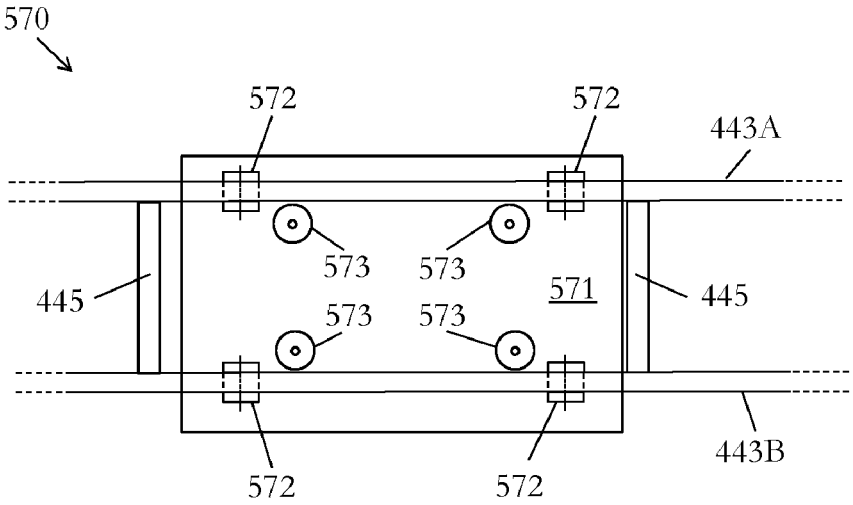
FIG. 8 is an underside schematic view a trolley on a bridge deck.

An example of a trolley is shown in FIG. 8. The view is an underside view showing the base 571 of the trolley 570 which is rectangular. Two sets of wheels 572, 573 are indicated as will be explained in more detail below.

The trolley is arranged on top of the stiles 443A, 443B of a bridge deck formed of a ladder-like member. Tread or interconnecting members 445 extend therebetween to define the shape of the ladder and for strength and stability thereof.

The first set of wheels 573 has their axes of rotation in a vertical manner, in use, such that the axes are perpendicular to the longitudinal length of the bridge deck. The wheels are all arranged between the two stiles 443A, 443B and press against their inside faces so that the trolley 570 cannot move laterally off the deck.

The second set of wheels 572 are arranged with the axes of rotation substantially horizontal in use such that wheels will roll over and along the tops of the stiles 443A, 443B.

More, or less, than four wheels in each set may be provided. For instance, three, or six may be employed.

Other means for maintaining the trolley on top of the deck and to avoid it falling off are contemplated such as clips which clip underneath the stiles, or channels arranged on the tops and/or bottoms of the stiles, forming lateral guides for the trolley wheels to move within. The channels may be an integral component of the main deck stringers, possibly formed within the main stringer extrusions.

Figure 9:
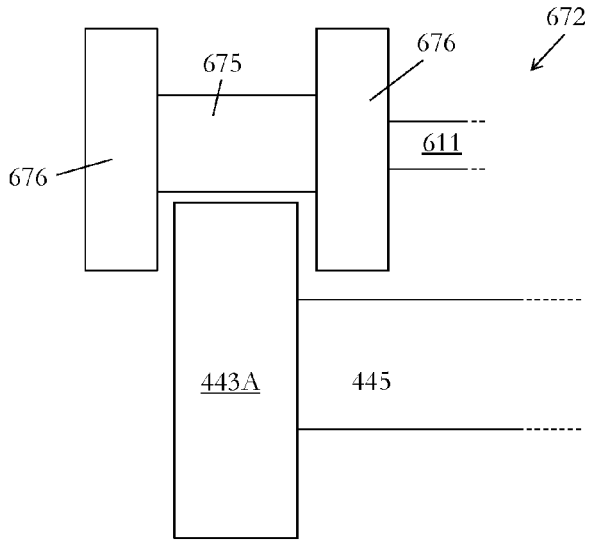
FIG. 9 is a schematic cross-sectional view of a trolley wheel on a bridge deck stringer.

Another method is to use wheels 672 having the shape generally indicated in FIG. 9. Each wheel has two outer parts 676 with a first radius which is greater than an intermediate central part 675 which joins the two outer parts. The central part 675 has a width suitable to rest and travel along the top of the stile 443A. The outer parts 676 with their greater radius lie to either side of the stile. Means for easing the rotation of the outer parts 676 where they contact the sides of the stiles may be provided such as ball bearings, grease and the like. An axle 611 is partially shown which may connect adjacent pairs of wheels.

Figure 10:
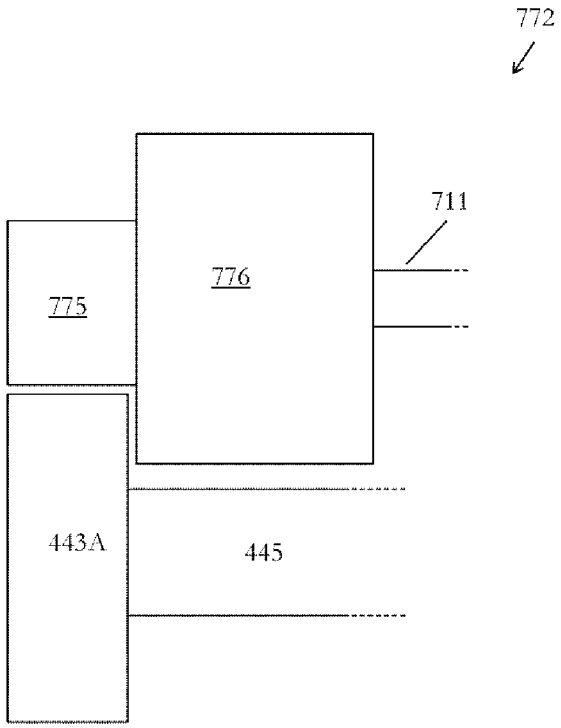
FIG. 10 is a schematic cross-sectional view of an alternative trolley wheel on a bridge deck stringer.

An alternative is trolley wheel 772 is shown in FIG. 10 comprising a relatively wide inner portion 776 and an outer portion 775. The outer portion 775 is for running along the top of the stile 443A. The inner portion provides location against the inside of the stile but also provides a surface on which the trolley can run when arranged with its wheels lowermost. The wider portion will assist in spreading the weight of the trolley and bridge during launching. An axle 711 is partially shown which may connect adjacent pairs of wheels.

Although bridges with only two or four sections have been described it is to be understood that the number of sections may be any number. At the junction of each section a deck column may be arranged although these may be arranged, as well as, or instead of, at other points on the bridge deck.

The third deck columns may only be arranged on some, or all, of the sections of the bridge.

Rather than a single cable extended across the bridge from one end to the other and arranged over the tops of the first and second deck columns individual cables may be used which extend only across each section, or more than one section. For instance, a cable may be used to extend from the end of the bridge deck to the top of the first second deck column. Another cable may then extend from the top of the first second deck column to the top of the first deck column and so on. In this regard, the term "top" is used with the bridge in its initially assembled form for launching and not in its final position ready for use.

Although all abutments 20, 30 in the figures are shown as being approximately level with one another it is to be understood that the system will work equally well when the abutments are at different levels.

Although cables are described as passing over, or connected to, the end of columns it is to be understood that they could also pass through, or be connected to, the columns at other points along their lengths.

Each bridge section may comprise a ladder having a length in the range of 2 to 8 meters. Where each bridge deck section comprises a series of sub-sections, each subsection may have a length in the range of 1.2 to 2.0 meters (+/−0.3 meters). In this respect the term "ladder" refers to an ordinary, commonly available ladder having two stiles and a number of rungs.

It is contemplated that deck columns may connect with the bridge deck at points other than where adjacent bridge sections meet.

The deck columns may have a rectangular shape formed of two side members each one extending from a stringer of the bridge deck such that the overall width of the columns are the same as the bridge deck. The side members may be connected together with flexible but inextensible cables, or rigid/stiff rods and the like.

Any or all cables described with reference to the figures could be replaced by other flexible but substantially inextensible members such as ropes, chains and wires, or by axially stiff members such as rods, tubes, ladders, trusses and the like.

It is contemplated that the bridge system may be leant up against an object such as a building and used to move materials up the system.

The location of the attachment of any deck column to the bridge may be at the centre of the width of the deck between the two long sides, on one long side or at a point between the centre and one long side.

The deck may be fitted with decking elements for pedestrian or vehicle traffic. The decking elements may comprise half-width footplates, staggered between alternate rungs, where present. They may comprise lightweight composite or alloy planks spanning between main column positions, with intermediate support derived from individual ladder floor beams and stringers.

The invention claimed is:

1. A bridging system comprising a bridge and a trolley, the bridge comprising a bridge deck having at least two pre-formed bridge sections in the form of ladders, each ladder having structural rigidity provided by at least two box section stringers connected together by at least one rung, and a connector for releasably connecting the at least two ladders together, the trolley including a set of wheels with a track width configured such that in use with the trolley located on the bridge deck, at least one wheel contacts one stringer and at least one other wheel contacts another stringer, the system further including guides for maintaining the at least one wheel in contact with the one stringer and for maintaining the at least one other wheel in contact with one of the other at least two stringers such that the trolley and bridge deck remain in contact while moving relative to, or with, one another for the launching of the bridge deck over a space to be bridged, the trolley being configured to carry goods and/or personnel over, and along, the bridge deck after the bridge has been positioned over the space to be bridged.

2. The bridging system according to claim 1, wherein the bridge deck has a deck plane lying parallel thereto in which the at least two stringers both lie, and the system further comprises at least one deck column extendable out of the deck plane away from the bridge deck, and at least one cable for connecting the bridge deck to the at least one deck column.

3. The bridging system according to claim 2, wherein the at least one column is releasably or pivotably attachable to the bridge deck, or to at least one bridge section.

4. The bridging system according to claim 1, wherein the connector for connecting the at least two bridge sections together comprises a hinge such that in a first position the at least two stringers of each bridge section lie immediately adjacent one another, and in a second position the at least stringers of each bridge sections are linearly located in line with one another.

5. The bridging system according to claim 1, wherein the at least two stringers are linearly hollow and the connector for connecting the at least two bridge sections together comprises a member configured for insertion into an end of two linearly adjacent stringers.

6. The bridging system according to claim 1, further comprising a launch nose section releasably attachable to one end of the bridge deck to aid launching of the bridge over the space to be bridged.

7. The bridging system according to claim 1, further comprising a tail section releasably attachable to one end of the bridge deck for loading thereof to aid launching of the bridge over the space to be bridged.

8. The bridging system according to claim 1, further comprising at least one side column extendable away from the side of the bridge deck and at least one cable for being arranged to one side of the bridge deck by the at least one side column, the cable being attachable at both ends thereof to the bridge deck either side of the side column.

9. A method of bridging a space comprising the steps of:

a) providing a bridging system, a bridge, and a trolley, the bridge comprising a bridge deck having at least two pre-formed bridge sections in the form of ladders, each ladder having structural rigidity provided by at least two box section stringers connected together by at least one rung, and a connector for releasably connecting the at least two ladders together, the trolley including a set of wheels with a track width configured such that in use with the trolley located on the bridge deck, at least one wheel contacts one stringer and at least one other wheel contacts another stringer, the system further including guides for maintaining the at least one wheel in contact with the one stringer and for maintaining the at least one other wheel in contact with one of the other at least two stringers such that the trolley and bridge deck remain in contact while moving relative to, or with, one another for the launching of the bridge deck over a space to be bridged, the trolley being configured to carry goods and/or personnel over, and along, the bridge deck after the bridge has been positioned over the space to be bridged;

b) assembling the bridge on one side of the space to be bridged; and c) arranging the trolley with the wheels uppermost and sliding the assembled bridge out over the space until the bridge spans the space.

10. A method of bridging a space comprising the steps of:

a) providing a bridging system, a bridge, and a trolley, the bridge comprising a bridge deck having at least two pre-formed bridge sections in the form of ladders, each ladder having structural rigidity provided by at least two box section stringers connected together by at least one rung, and a connector for releasably connecting the at least two bridge sections together, the trolley including a set of wheels with a track width configured such that in use with the trolley located on the bridge deck, at least one wheel contacts one stringer and at least one other wheel contacts another stringer, the system further including guides for maintaining the at least one wheel in contact with the one stringer and for maintaining the at least one other wheel in contact with one of the other at least two stringers such that the trolley and bridge deck remain in contact while moving relative to, or with, one another for the launching of the bridge deck over a space to be bridged, the trolley being configured to carry goods and/or personnel over, and along, the bridge deck after the bridge has been positioned over the space to be bridged;

b) part-assembling the bridge on one side of the space to be bridged; and c) arranging the trolley with the wheels uppermost and sliding the part-assembled bridge out over the space, and adding further bridge sections, columns, and tensioning members, and further launching the extended bridge structure until the bridge spans the space.

11. A method of bridging a space according to claim 9, wherein step c) is undertaken with the at least one deck column arranged above or parallel to the horizontal, the method further comprising the step of rotating the bridge, such that the at least one column is arranged underneath the bridge deck, after the bridge has been arranged to span the space.

12. A method of bridging a space according to claim 9, further comprising the step of providing a trolley to run on the upper surface of the bridge deck to thereby transfer goods and/or personnel from one side to the other side of the space.

* * * * *